US006421941B1

(12) United States Patent
Finke et al.

(10) Patent No.: US 6,421,941 B1
(45) Date of Patent: Jul. 23, 2002

(54) DESIGNATION WINDOW

(75) Inventors: Thomas R. Finke, Medina; Roy L. Henneberger, Apple Valley, both of MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/608,380

(22) Filed: Jun. 30, 2000

(51) Int. Cl.[7] ..... G09F 7/18
(52) U.S. Cl. ..... 40/611; 40/661; 174/66
(58) Field of Search ..... 40/661, 55, 661.08, 40/611.11, 611, 299.01, 336; 174/66; D8/358, 353

(56) References Cited

U.S. PATENT DOCUMENTS

| | | | | | |
|---|---|---|---|---|---|
| 1,930,610 | A | | 10/1933 | Despard | |
| 3,438,536 | A | * | 4/1969 | Tarchalski | 220/242 |
| 3,921,798 | A | | 11/1975 | Dean et al. | 206/53 |
| D360,352 | S | * | 7/1995 | House et al. | D8/353 |
| 5,575,100 | A | | 11/1996 | Marvin et al. | 40/642 |
| 5,594,206 | A | * | 1/1997 | Klas et al. | 174/66 |
| 5,613,874 | A | | 3/1997 | Orlando et al. | 439/491 |
| 5,735,708 | A | * | 4/1998 | Arnett et al. | 174/66 X |
| 5,862,616 | A | | 1/1999 | Peroni | 40/611 |
| 5,933,994 | A | | 8/1999 | Misaresh | 40/649 |
| 5,961,345 | A | | 10/1999 | Finn et al. | 439/536 |

OTHER PUBLICATIONS

The Siemon Company Catalog, 1997, pp. 120–121.
Exhibit 1; 1997; 3 pages of photocopied photographs showing designation strip and faceplate from Siemon Company catalog.
Hubbell catalog, "Solutions by Design", pp. 40–43.

* cited by examiner

*Primary Examiner*—Stephen T. Gordon
*Assistant Examiner*—Jason Morrow
(74) *Attorney, Agent, or Firm*—Merchant & Gould P.C.

(57) ABSTRACT

A designation window including a transparent strip member having a front side and a back side. The strip member also includes a length and a width. Finger grips are provided on the front side of the strip member. The fingers grips include outwardly facing gripping surfaces that extend across the width of the strip and have concave curvatures.

32 Claims, 6 Drawing Sheets

DESIGNATION WINDOW

FIELD OF THE INVENTION

The present invention relates generally to devices for mounting designation cards on telecommunications equipment (e.g., patch panels, faceplates, media boxes, etc.) for the purpose of station or connector identification. More particularly, the present invention relates to designation windows for securing designation cards to telecommunications equipment.

BACKGROUND OF THE INVENTION

Designation cards (e.g., paper strips displaying information) are used for various types of telecommunications media (e.g., voice, data and video) to provide connector identification or labeling. Common types of information displayed by designation cards include subnets for data outlets and phone numbers for voice outlets. Typical types of telecommunications equipment on which designation cards are commonly used include connector mounts such as patch panels, faceplates, media boxes, etc.

Connector mounts commonly include recesses for mounting designation cards. Designation windows are frequently used to hold designation cards within the recesses. A conventional designation window is formed by a strip of flexible, transparent plastic. To secure a designation strip within a recess, the designation strip is placed within the recess, and then the designation window is snap-fit within the recess over the designation card. A problem with conventional designation windows is that they are often difficult to remove. Some require the use of a prying tool such as a screwdriver.

SUMMARY OF THE INVENTION

One aspect of the present invention relates to a designation window including a strip member having finger grips including gripping surfaces that project forwardly from a front side of the strip member. The gripping surfaces face away from one another, and each of the gripping surfaces has a concave curvature.

Another aspect of the present invention relates to a designation window including a strip member having finger grips located at the front side of the strip member. The finger grips include forward most edges that extend across a width of the strip member. Gripping surfaces are defined between a front surface of the strip member and the forward most edges of the finger grips.

A variety of advantages of the invention will be set forth in part in the description that follows, and in part will be apparent from the description, or may be learned by practicing the invention. It is to be understood that both the forgoing general description and the following detailed description are explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION

Figure 1:
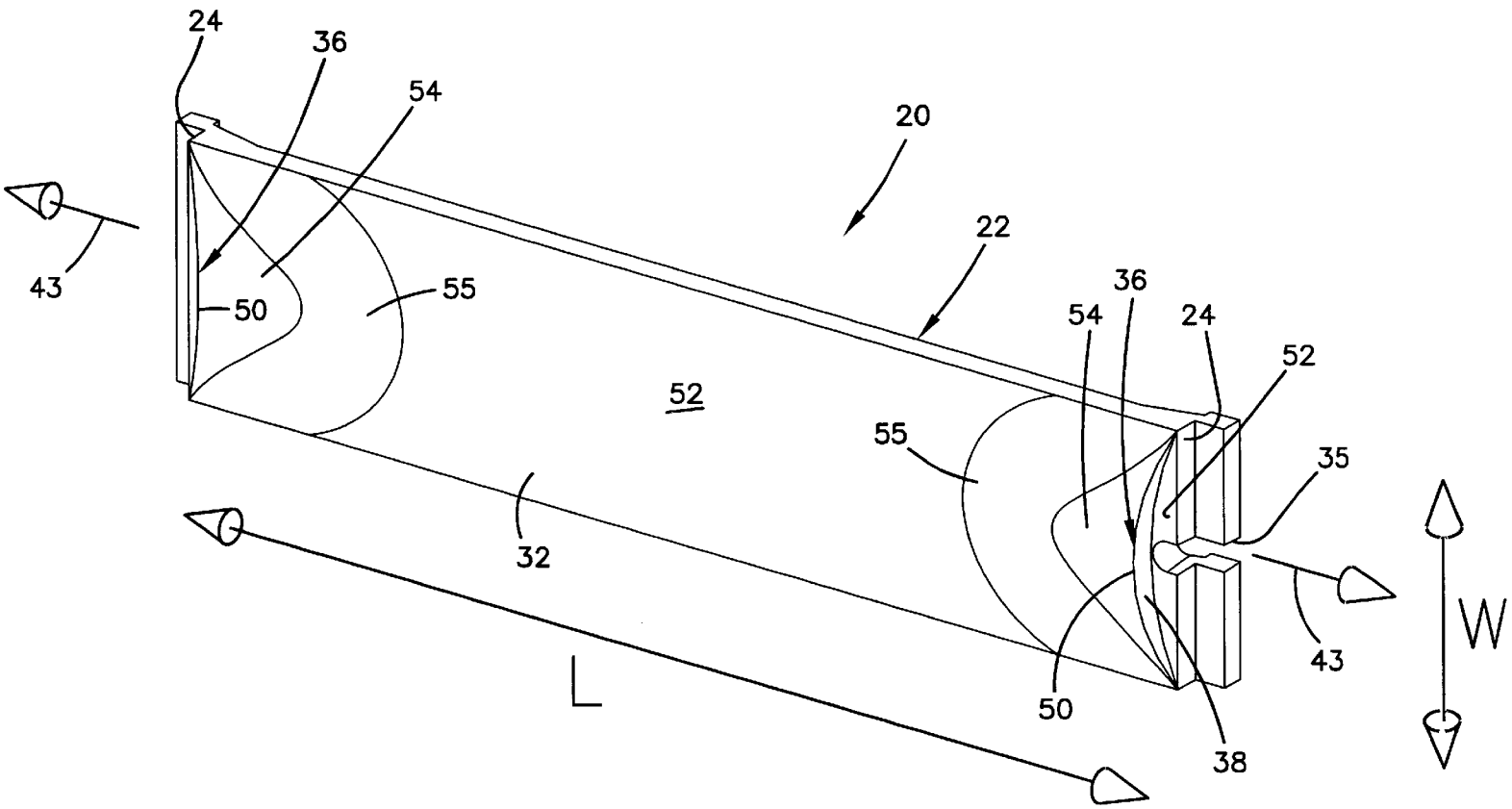
FIG. 1 is a perspective view of a designation window constructed in accordance with the principles of the present invention.

Reference will now be made in detail to exemplary aspects of the present invention that are illustrated in the accompanying drawings. Wherever possible, the same reference numbers will be used throughout the drawings to refer to the same or like parts.

The FIGS. 1–7 illustrate a designation window 20 constructed in accordance with the principles of the present invention. The designation window 20 includes a strip member 22 preferably made of transparent, resilient material such as plastic. The strip member 22 is generally rectangular and includes a length L and a width W. Ends 24 of the strip member 22 are separated by the length L. Retaining tabs 26 project longitudinally outwardly (i.e., in directions indicated generally by arrows 43) from the ends 24 of the strip member 22. The retaining tabs 26 and the ends 24 cooperate to define end notches 28 (best shown in FIGS. 4 and 5).

While the designation window 20 is preferably transparent (i.e., capable of being seen through), it could also be opaque or pigmented. In certain embodiments, the designation window could be color coded with given colors representative of certain designations. In still other embodiments, designation information could be printed, stamped, cut, formed or otherwise provided directly in or on the designation window.

Figure 3:
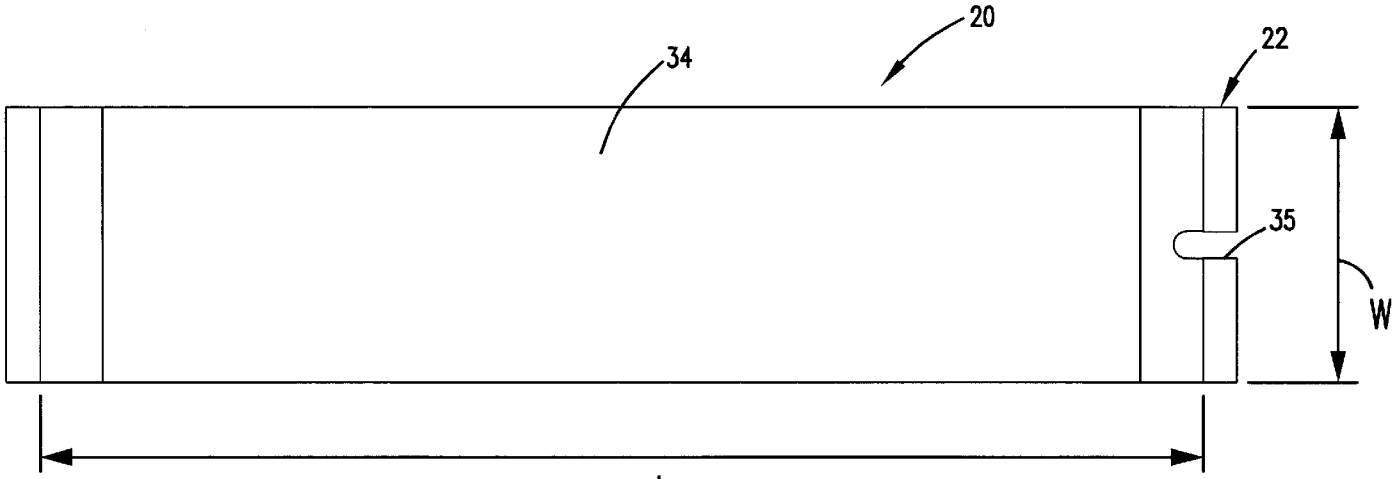
FIG. 3 is a back view of the designation window of FIG. 1.
Figure 2:
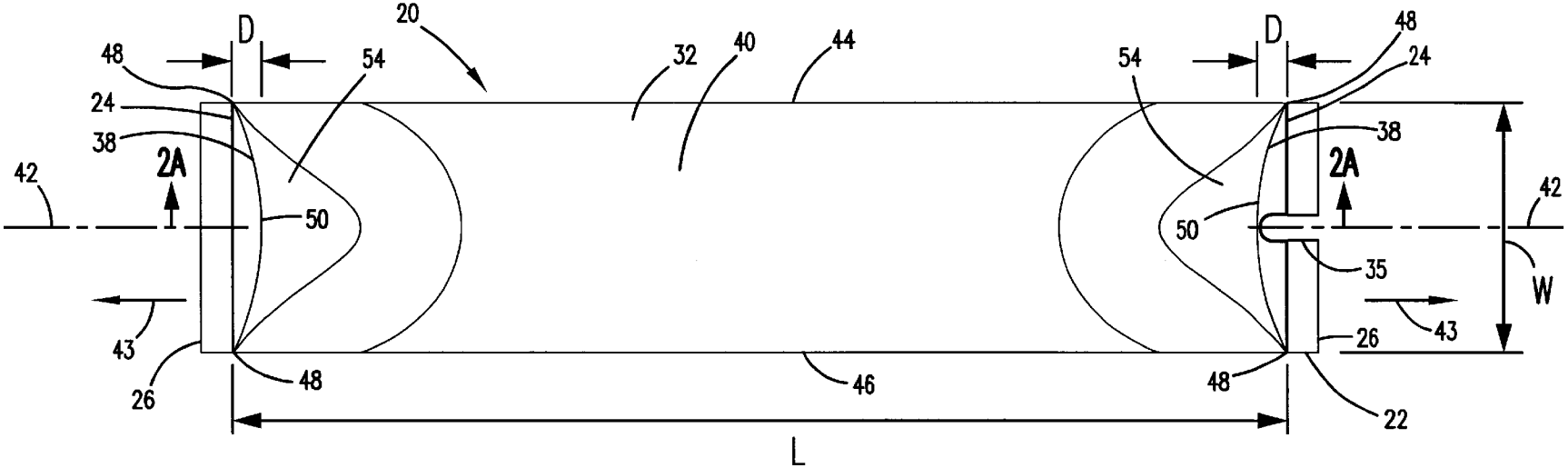
FIG. 2 is a front view of the designation window of FIG. 1.

As shown in FIGS. 2 and 3, a longitudinal slot 35 is provided adjacent one of the ends 24. The slot 35 is sized to receive a tool such as a pen tip. Thus, if desired, a user can remove the window 20 from a recess by inserting a pen tip in the slot 35, and then prying the window from the recess. However, as described below, the designation window 20 also includes structure for allowing a user to readily remove the designation window 20 from a recess without requiring the use of a tool.

The strip member 22 includes a front side 32 (shown in FIG. 2) and a backside 34 (shown in FIG. 3). Finger grips 36 are provided on the front side 32 of the strip member 22. The front side 32 includes a front surface 52. The finger grips 36 project forwardly from the front surface 52 of the strip member 22 and are configured for assisting a user in removing the designation window 20 from a recess without using a tool. For example, the finger grips 36 are positioned adjacent the ends 24 of the strip member 22 and include gripping surfaces 38 that face longitudinally outwardly from the strip member 22 (i.e., gripping surface preferably face away from one another as shown by arrows 43).

Figure 10:
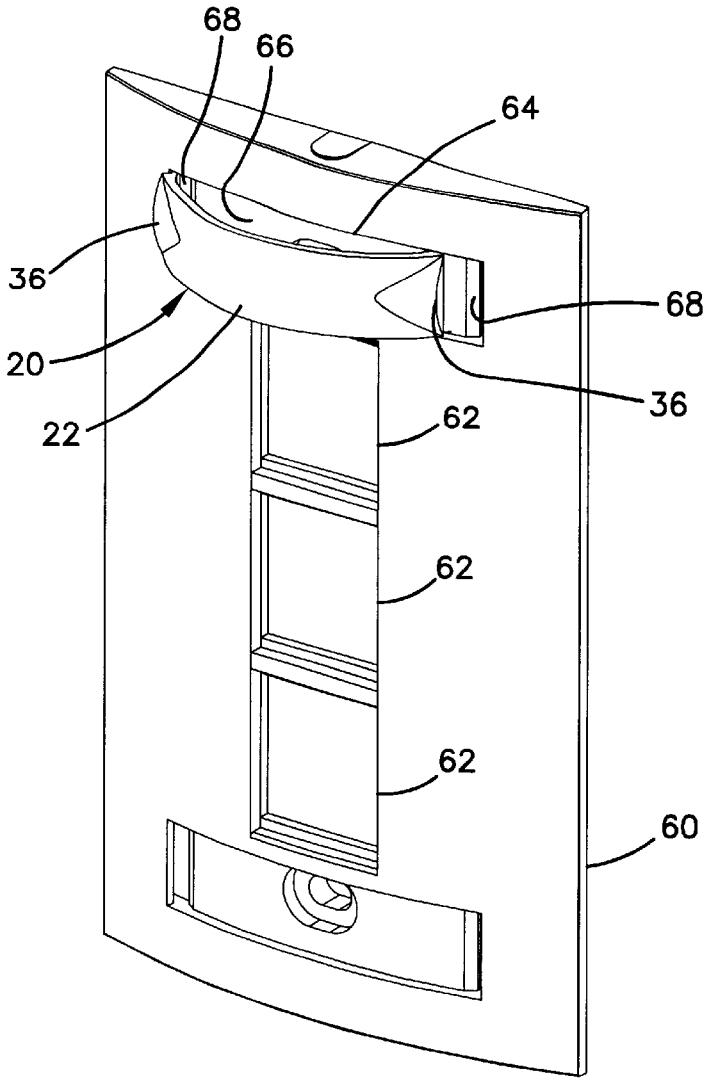
FIG. 10 is a perspective view showing the designation window of FIG. 1 in the process of being inserted into the faceplate.
Figure 11:
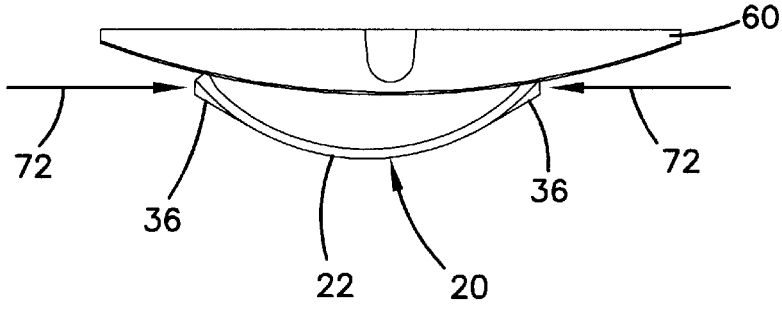
FIG. 11 is a top view of the faceplate of FIG. 10.

Preferably, each of the gripping surfaces 38 extends forwardly from the front side 32 of the strip member 22 a sufficient distance to allow a user flex the strip member 22 (as shown in FIGS. 10 and 11) by pressing longitudinally inwardly against the gripping surfaces 38 with his or her finger tips or finger nails. In one embodiment, the gripping surfaces 38 have maximum heights H (shown in FIGS. 6 and 7) of at least 0.045 inches.

As best shown in FIG. 2, the gripping surfaces 38 extend across the width W of the strip member 22. Preferably, the gripping surfaces 38 define concave curvatures as the gripping surface 38 extend across the width W of the strip member 22. The concave curvatures can be configured to generally match the curvature of a typical user's finger tip or finger nail. In one non-limiting embodiment, each concave curvature is defined by an arc having a radius of about 0.5 inches. The curvatures of the gripping surfaces 38 cause at least portions of the gripping surfaces 38 to be inwardly offset with respect to their corresponding ends 24 of the strip member 22. As shown in FIG. 2, each of the gripping surfaces 38 has a maximum offset distance D from its corresponding end 24 at a longitudinal center line 42 of the strip member 22.

Still referring to FIG. 2, the strip member 22 includes first and second sides 44 and 46 between which the width W of the strip member 22 extends. The first and second sides 44 and 46 of the strip member 22 meet with the ends 24 of the strip member 22 at comers 48. Preferably, the gripping surfaces 38 extend across the entire width W of the strip member 22 and terminate at the comers 48.

Figure 2A:
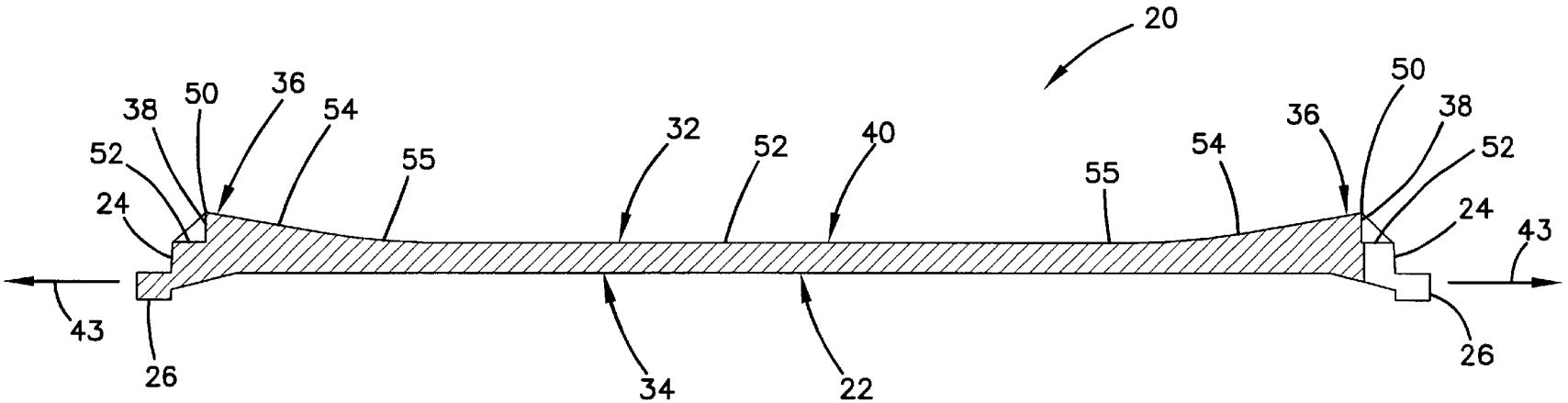
FIG. 2A is a cross-sectional view taken along section line 2A—2A of FIG. 2.
Figure 7:
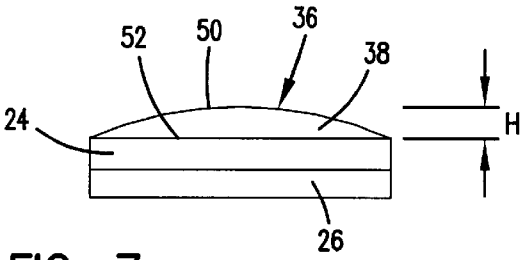
FIG. 7 is a right end view of the designation window of FIG. 1.
Figure 6:
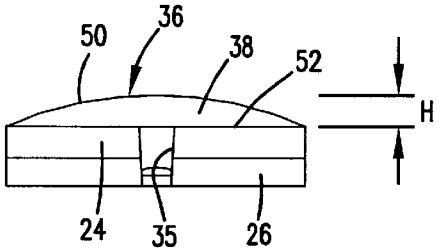
FIG. 6 is a left end view of the designation window of FIG. 1.

Referring to FIGS. 1, 6 and 7, the finger grips 36 include forward most edges 50 (i.e., the apexes of the finger grips 36) that extend across the width W of the strip member 22. Each of the gripping surfaces 38 is defined between the front surface 52 of the strip member 22 and one of the forward most edges 50 of the finger grips 36. The forward most edges 50 are preferably curved such that the maximum height H of each finger grip 36 is at the longitudinal centerline 42 of the strip member 22. When viewed from the ends of the strip member 22 as shown in FIGS. 6 and 7, the finger grips 36 are generally dome-shaped. As shown in FIG. 2A, each of the gripping surfaces 38 is preferably aligned generally at a perpendicular angle with respect to the front surface 52 of the strip member 22.

Figure 4:
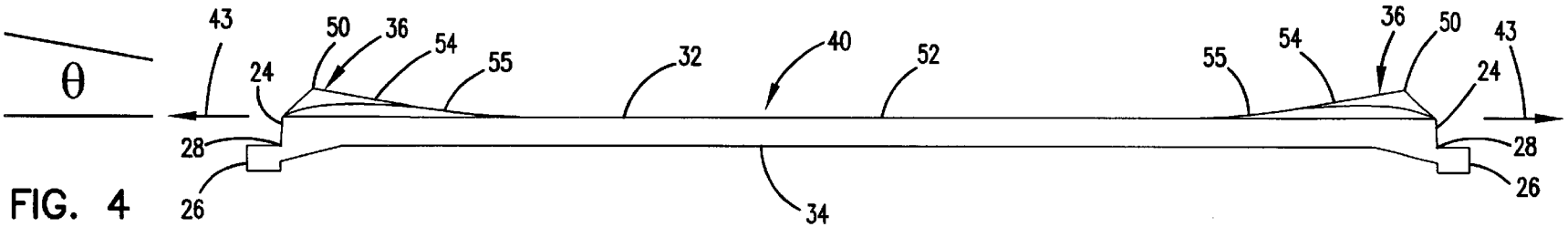
FIG. 4 is a top view of the designation window of FIG. 1.
Figure 5:
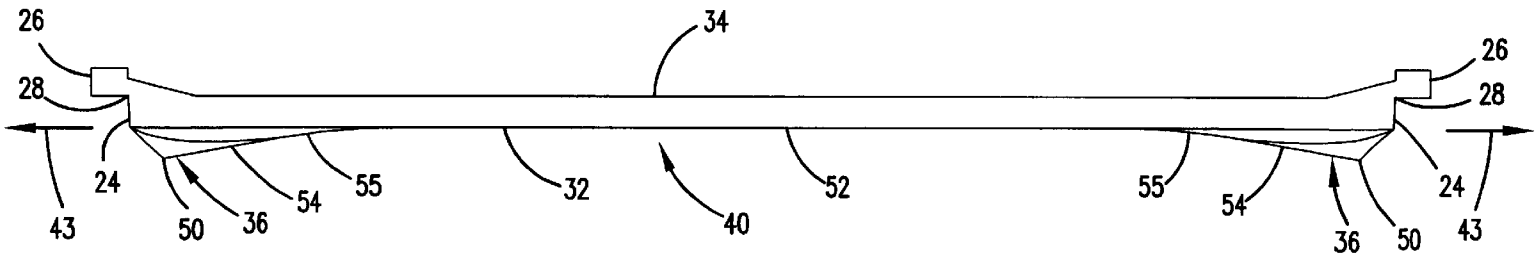
FIG. 5 is a bottom view of the designation window of FIG. 1.

Preferably, the finger grips are blended into the primary thickness of the strip member 22 in such a manner as to minimize the optical distortion and allow for clear visibility of a designation card mounted behind the designation window 20. For example, as shown in FIGS. 2 and 4, the finger grips 36 include sloped portions 54 that extend from the forward most edges 50 toward a mid region 40 of the strip member 22. Preferably, the sloped potions 54 slope gradually downwardly as the sloped portions 54 extend from the forward most edges 50 toward the mid region 40. In one embodiment, the sloped portions are oriented at angles 0 less than 20 degrees relative to the front surface 52 of the strip member 22. Preferably, the angles 0 are about 10 degrees. As best shown in FIGS. 2 and 4, curved transitions 55 assist in blending the sloped portions 54 with the front surface 52 of the strip member 22. In one non-limiting embodiment, each curved transition 55 is defined by an arc having a radius of about 1 inch.

Figure 8:
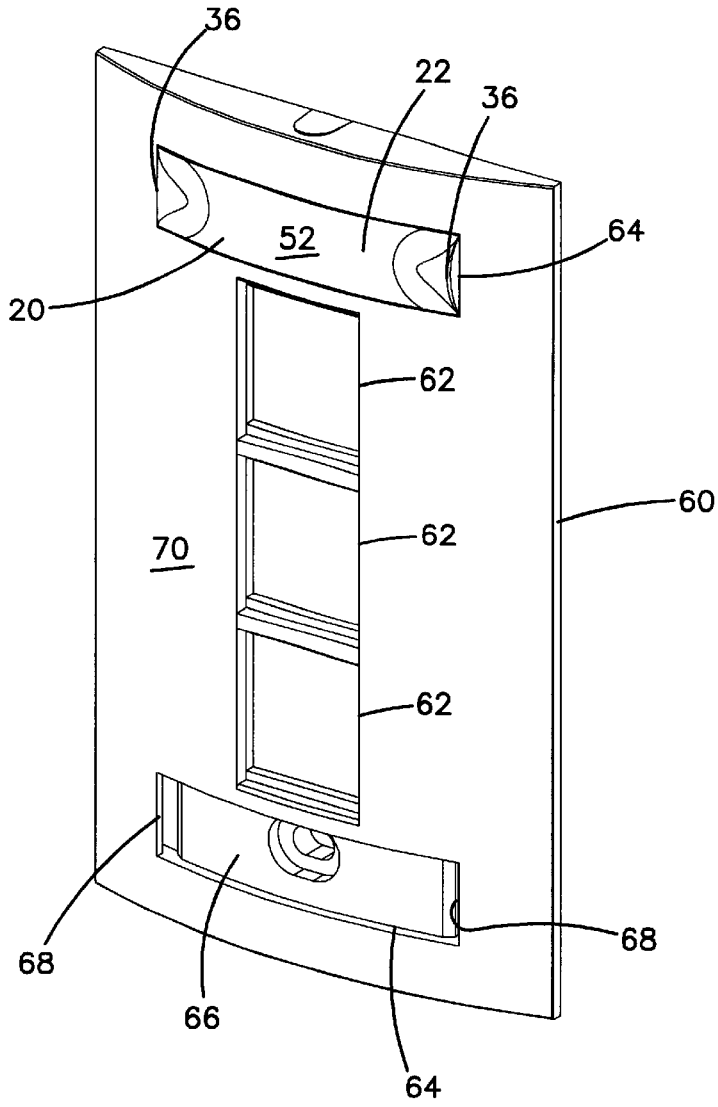
FIG. 8 is a perspective view of a faceplate on which the designation strip of FIG. 1 is mounted.
Figure 9:
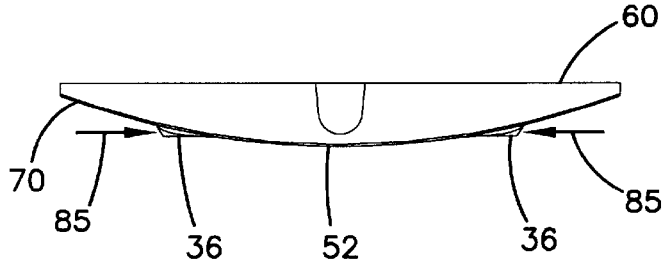
FIG. 9 is a top view of the faceplate of FIG. 8.

FIGS. 8 and 9 show a faceplate 60 defining openings 62 sized for mounting telecommunications connectors (not shown). The faceplates 60 also include recesses 64 for mounting the designation windows 20. The recesses 64 are defined by recessed support surfaces 66. Through-holes 68 are provided at the ends of the recessed support surfaces 66.

The faceplate 60 includes a front surface 70 that has a convex curvature. When one of the designation windows 20 is mounted within one of the recesses 64, the strip member 22 is held in an elastically deformed, longitudinally curved configuration. In such a configuration, the front surface 52 of the strip member 22 is generally flush with the front surface 70 of the faceplate 60 (i.e., the curvature of the front surface 52 matches the curvature of the front surface 70).

In FIG. 8, one of the designation windows 20 is shown mounted within the uppermost recess 64 of the faceplate 60. As so mounted, the front surface 52 is convexly curved along its length so as to match the curvature of the front surface 70 of the faceplate 60. Additionally, as best shown in FIG. 9, the finger grips 36 project outward beyond the front surface 70 of the faceplate 60.

To use the designation windows 20, a printed designation card (e.g., a paper strip having identifying information printed or otherwise provided thereon) is first placed within one of the recesses 64. One of the designation windows 20 is then flexed as shown in FIGS. 10 and 11 by manually pressing on the gripping surfaces 38 of the finger grips 36 as indicated by vector arrows 72. The forces applied to the gripping surfaces 38 cause the strip member 22 to elastically bend along its length. In the bent configuration, the retaining tabs 26 can be inserted into the recess 64. Once the retaining tabs 26 have been inserted into the recess 64, the strip member 22 is released causing the strip member 22 to flex outward. As the strip member 22 flexes outward, the retaining tabs 26 slide into the through-holes 68 and behind the back surface of the faceplate 60. In such a configuration, the retaining tabs 26 engage the backside of the faceplate 62 to retain the designation window 20 within the recess 64. As so positioned, the designation strip is captured between the designation window 20 and the recessed support surface 66, and is visible through the designation window 20.

Alternatively, the window 20 can be mounted in the recess 64 by inserting one of the tabs 26 into its corresponding through-hole 68, and then pressing the gripping surface 38 at the opposite end of the window 20 to flex the strip member 22. Once the strip member 22 has been flexed a sufficient amount, the non-inserted tab 26 can be placed into its corresponding through-hole 68. Thereafter, pressure is removed from the gripping surface 38 such that the strip is allowed to straighten and securely seat itself within the recess 64. For such an insertion technique, it will be appreciated that only one grip is required. Thus, certain embodiments of the present invention can have a single grip located at one end of the strip.

To remove the designation window 20 from the recess 64, at least one of the gripping surfaces 38 is manually pressed (as shown by arrows 85 in FIG. 9) to flex the strip member 22. With the strip member 22 flexed, at least one of the retaining tabs 26 is displaced from its corresponding through-hole 68, and the strip member 22 can be removed from the recess 64. The relatively low profiles of the grips 36, combined with the in-set configuration of the gripping surfaces 38 caused by the concave curvatures, assist in preventing the gripping surfaces 38 from being inadvertently engaged such that the window is unintentionally dislodged from the recess 64.

With regard to the forgoing description, it is to be understood that changes may be made if in detail, especially in matters of the construction materials employed and the size, shape and arrangement of the parts without departing from the scope of the present invention. It is intended that the specification and depicted embodiment be considered exemplary only, with a true scope and spirit of the invention being indicated by the broad meaning of the following claims.

What is claimed is:

1. A designation window comprising:

a strip member having a length and a width, the strip member including opposite ends separated by the length, the strip member also including a front side positioned opposite from a backside;

retaining tabs that project outwardly from the ends of the strip member, the retaining tabs and the ends cooperating to define end notches; and finger grips that project forwardly from the front side of the strip member, the finger grips being positioned adjacent the opposite ends of the strip member and including gripping surfaces that face away from one another, the gripping surfaces extending forwardly from the front side of the strip member and also extending across the width of the strip member, and the gripping surfaces defining concave curvatures as the gripping surfaces extend across the width of the strip member.

2. The designation window of claim 1, wherein each of the gripping surfaces is inwardly offset with respect to its corresponding end of the strip member.

3. The designation window of claim 2, wherein the gripping surfaces extend across the entire width of the strip member.

4. The designation window of claim 2, wherein the gripping surfaces have maximum offsets from their corresponding ends of the strip member, the maximum offsets being located at a longitudinal centerline of the strip member.

5. The designation window of claim 4, wherein the strip member includes first and second sides between which the width of the strip member extends, wherein the first and second sides meet with the ends of the strip member at comers, and wherein the gripping surfaces terminate at the comers.

6. The designation window of claim 1, wherein the strip member includes a front surface, wherein the finger grips include forward most edges that extend across the width of the strip member, and wherein the gripping surfaces are defined between the front surface of the strip member and the forward most edges of the finger grips.

7. The designation window of claim 6, wherein the forward most edges are curved such that each of the finger grips has a maximum height at a longitudinal centerline of the strip member, the maximum height being measured from the front surface of the strip member.

8. The designation window of claim 7, wherein the finger grips are generally dome-shaped when viewed from the ends of the strip member.

9. The designation window of claim 7, wherein the strip member includes first and second sides between which the width of the strip member extends, wherein the first and second sides meet with the ends of the strip member at comers, and wherein the forward most edges terminate at the comers.

10. The designation window of claim 6, wherein the gripping surfaces are generally perpendicularly aligned with respect to the front surface of the strip member.

11. The designation window of claim 10, wherein the finger grips include sloped portions that extend from the forward most edges toward a mid region of the strip member, the sloped portions sloping at angles less than 20 degrees relative to the front surface of the strip member.

12. The designation window of claim 1 1, wherein the sloped portions include curved transitions that blend with the front surface of the strip member.

13. An apparatus including the designation window of claim 1, further comprising a faceplate defining at least one opening sized for mounting a telecommunications connector, the faceplate also defining a recess sized for receiving the strip member.

14. The apparatus of claim 13, wherein when the strip member is positioned in the recess, the strip member is retained in an elastically deformed, longitudinally curved configuration.

15. The apparatus of claim 13, wherein the faceplate has a curved front face, and wherein when the strip member is positioned in the recess, the front side of the strip member has a curvature that generally matches the curvature of the front face.

16. A designation window comprising:

a strip member having a length and a width, the strip member including ends opposite separated by the length, the strip member also including a front side positioned opposite from a back side, the front side including a front surface;

retaining tabs that project outwardly from the ends of the strip member, the retaining tabs and the ends cooperating to define end notches;

a finger grip that projects forwardly from the front side of the strip member, the finger grip being positioned adjacent one end of the strip member and including a gripping surface that faces longitudinally outwardly from the strip member; and the finger grip including a forward most edge that extends across the width of the strip member, and the gripping surface being defined between the front surface of the strip member and the forward most edge of the finger grip.

17. The designation window of claim 16, wherein the gripping surface extends across the width of the strip member, and wherein the gripping surface is inwardly offset with respect to its corresponding end of the strip member.

18. The designation window of claim 17, wherein the gripping surface extends across the entire width of the strip member.

19. The designation window of claim 17, wherein the gripping surface is concave and has a maximum offset from its corresponding end of the strip member, the maximum offset being located at a longitudinal centerline of the strip member.

20. The designation window of claim 19, wherein the strip member includes first and second sides between which the width of the strip member extends, wherein the first and second sides meet with the ends of the strip member at comers, and wherein the gripping surface terminates at two of the comers.

21. The designation window of claim 16, wherein the forward most edge is curved such that the finger grip has a maximum height at a longitudinal centerline of the strip member, the maximum height being measured from the front surface of the strip member.

22. The designation window of claim 21, wherein the finger grip is generally dome-shaped when viewed from the end of the strip member.

23. The designation window of claim 21, wherein the strip member includes first and second sides between which the width of the strip member extends, wherein the first and second sides meet with the ends of the strip member at comers, and wherein the forward most edge terminates at two of the comers.

24. The designation window of claim 16, wherein the gripping surface is generally perpendicularly aligned with respect to the front surface of the strip member.

25. The designation window of claim 16, wherein the finger grip includes sloped portions that extend from the forward most edge toward a mid region of the strip member, the sloped portions sloping at an angle less than 20 degrees relative to the front surface of the strip member.

26. The designation window of claim 25, wherein the sloped portion includes a curved transition that blends with the front surface of the strip member.

27. The designation window of claim 25, wherein the gripping surface is generally perpendicularly aligned with respect to the front surface of the strip member.

28. An apparatus including the designation window of claim 16, further comprising a faceplate defining at least one opening sized for mounting a telecommunications connector, the faceplate also defining a recess sized for receiving the strip member.

29. The apparatus of claim 28, wherein when the strip member is positioned in the recess, the strip member is retained in an elastically deformed, longitudinally curved configuration.

30. The apparatus of claim 28, wherein the faceplate has a curved front face, and wherein when the strip member is positioned in the recess, the front side of the strip member has a curvature that generally matches the curvature of the front face.

31. A designation window comprising:

a strip member having a front side and a back side, the strip member including a length and a width, and the strip member including a mid region positioned between two ends; and a finger grip that projects forwardly from the front side of the strip member, the finger grip being located adjacent one end of the strip member and including a gripping surface that faces outwardly from the mid region of the strip member, the gripping surface extending across the width of the strip member, and the gripping surface having a concave curvature.

32. The designation window of claim 31, wherein a portion of the grip is sloped to minimize optical distortion.

* * * * *

UNITED STATES PATENT AND TRADEMARK OFFICE

CERTIFICATE OF CORRECTION

PATENT NO. : 6,421,941 B1
DATED : July 23, 2002
INVENTOR(S) : Finke et al.

It is certified that error appears in the above-identified patent and that said Letters Patent is hereby corrected as shown below:

Column 5,
Lines 38 and 58, “comers, and” should read -- corners, and --
Lines 39 and 59, “comers.” should read -- corners. --

Column 6,
Line 1, “The designation window of claim 1 1,” should read -- The designation window of claim 11, --
Lines 52 and 66, “comers, and” should read -- corners, and --
Line 53, “of the comers.” should read -- of the corners. --
Line 67, “two of the comers.” should read -- two of the corners. --

Signed and Sealed this

Third Day of June, 2003

JAMES E. ROGAN
*Director of the United States Patent and Trademark Office*